US008337644B2

(12) United States Patent
Trenda et al.

(10) Patent No.: US 8,337,644 B2
(45) Date of Patent: Dec. 25, 2012

(54) ALUMINUM ALLOY

(75) Inventors: Günther Trenda, Dorfgastein (AT); Andreas Kraly, Lend (AT)

(73) Assignee: Aluminium Lend Gesellschaft m.b.H., Lend (AT)

( * ) Notice: Subject to any disclaimer, the term of this patent is extended or adjusted under 35 U.S.C. 154(b) by 109 days.

(21) Appl. No.: 11/920,759

(22) PCT Filed: May 18, 2006

(86) PCT No.: PCT/AT2006/000206

§ 371 (c)(1), (2), (4) Date: Apr. 23, 2009

(87) PCT Pub. No.: WO2006/122341

PCT Pub. Date: Nov. 23, 2006

(65) Prior Publication Data

US 2009/0214381 A1 Aug. 27, 2009

(51) Int. Cl.
*C22C 21/08* (2006.01)

(52) U.S. Cl. ..... 148/440; 420/544; 420/545

(58) Field of Classification Search ..... 148/415, 148/440; 420/544, 545
See application file for complete search history.

(56) References Cited

U.S. PATENT DOCUMENTS 5,578,144 A * 11/1996 Satou et al. ..... 148/415

FOREIGN PATENT DOCUMENTS

| | | | |
|---|---|---|---|
| AT | 412726 B | * | 5/2005 |
| AT | 412 726 | | 6/2005 |
| WO | WO 00/43560 | | 7/2000 |
| WO | WO 2005/047554 | | 5/2005 |

OTHER PUBLICATIONS

G. Trenda, et al., "Optimierung der mechanischen Eigenschaften von AlMgSi-Druckgusslegierungen", Sonderdruck Aus "Giesserei", vol. 92, No. 7, pp. 67-71, 2005.

Z. Yin, et al., "Effect of minor Sc and Zr on the microstructure and mechanical properties of Al-Mg based alloys", Materials Science and Engineering, vol. A280, pp. 151-155, 2000.

C. Yuyong, et al., "Influence of cerium and mischmetall cin the hardness and brightness of Al-Mg-Si alloys", Journal of Less-Common Metals, vol. 110, pp. 175-178, 1985.

R. Lundin, et al., "Rare Earth Metals", Advanced Materials and Processes, vol. 158, No. 1, pp. 52-55, 2000.

* cited by examiner

*Primary Examiner* — George Wyszomierski
*Assistant Examiner* — Janelle Morillo
(74) *Attorney, Agent, or Firm* — Cozen O'Connor

(57) ABSTRACT

An aluminum alloy, comprising magnesium 4.5 to 6.5% by weight, silicon 1.0 to 3.0% by weight, manganese 0.3 to 1.0% by weight, chromium 0.02 to 0.3% by weight, titanium 0.02 to 0.2 % by weight, zirconium 0.02 to 0.2% by weight, one or more rare earth metals 0.0050 to 1.6% by weight, iron max. 0.2% by weight, and the remainder aluminum.

7 Claims, No Drawings

ALUMINUM ALLOY

RELATED APPLICATIONS

This is a U.S. National Phase Application under 35 USC 371 of International Application PCT/AT2006/000206 filed on May 18, 2006.

This application claims the priority of Austrian application no. A 857/2005 filed May 19, 2005, the entire content of which is hereby incorporated by reference.

FIELD OF THE INVENTION

The invention concerns an aluminium alloy, in particular an aluminium alloy that in addition to aluminium comprises magnesium and silicon as main alloying components and is intended to be used for die casting and related processes.

BACKGROUND OF THE INVENTION

Aluminium die cast parts have achieved a particular significance in the automobile industry. The increasing mechanical demands placed on aluminium die cast parts in the automobile industry, prompted mainly by the substitution of steel components by aluminium alloys with the purpose of weight reduction, are met by using special AlSiMg or AlMgSi die cast alloys and a heat treatment following the casting process.

As an example, from AT 407 533 an aluminium alloy comprising >3.0 to 7.0% by weight magnesium, 1.0 to 3.0% by weight silicon, 0.3 to 0.49% by weight manganese, 0.1 to 0.3% by weight chromium, 0 to 0.15% by weight titanium, max. 0.15% by weight iron and max. 0.00005% by weight calcium and sodium each and max. 0.0002% by weight phosphorus.

In EP-B-0 792 380 an alloy is described, that comprises 3.0 to 6.0, preferably 4.6 to 5.8% by weight magnesium, 1.4 to 3.5, preferably 2.0 to 2.8% by weight silicon, 0.5 to 2.0, preferably 0.6 to 1.5% by weight manganese, max. 0.2, preferably 0.1 to 0.2% by weight titanium and max. 0.15, preferably max. 0.1% by weight iron and is already present in the rheo-structural state.

These known AlMgSi alloys are intended to be used for die casting and related processes. They have already in the cast state strength and elongation values similar to those of AlSiMg alloys, for example the known alloy of the $AlSi_7Mg_{0,3}$ type in the fully-hardened state (that is designated by "T6"). An important disadvantage of these AlMgSi type alloys is, however, that the 0.2% elongation limit is lower than that of AlSiMg alloys.

The 0.2% elongation limit characterises the transition from elastic to plastic deformation of a cast part and is particularly relevant in conjunction with possibly crash-affected structural parts in the automobile industry.

There are reports in the literature reports about the possibility of a short heat treatment, lasting for max. 2 hours, for the purpose of increasing the 0.2% elongation limit.

A heat treatment of die cast parts produced from the above mentioned AlMgSi alloys has, however, numerous disadvantages. First of all the cost advantage, that can be achieved by such alloys, is annulled. Further basic disadvantages of the heat treatment are typical defects of the die cast parts, like distortion, and above all blisters, occurring due to the thermal disintegration of the mould release agents included, known under the term "blister". A distortion, however, negates the advantage of the process of die cast parts, namely production with dimensions close to the final ones.

In the case of die cast parts, that are not subjected to heat treatment to increase the 0.2% elongation limit, the scope of application of the above described aluminium alloys is limited due to the relatively low 0.2% elongation limit, since especially for die cast parts subjected to load greater strength properties are required. The application of die cast parts, produced from such alloys, can be achieved only by increasing the thickness of their wall. However, the increase of the wall thickness reduces or negates the weight advantage achievable by using aluminium.

DETAILED DESCRIPTION OF THE PRESENTLY PREFERRED EMBODIMENTS

One object of this present invention is to provide aluminium alloys of the AlMgSi type, that are suitable to be used for die casting and have strength properties that are better than those known from the state-of-the-art, in particular an elongation limit that is greater than 0.2%. A further object of the invention is to provide aluminium alloys of the type that have the desired strength properties already in the cast state, so that a heat treatment of the die cast parts and consequently the associated disadvantages can be avoided. A further object of this present invention is to provide aluminium alloys, that can be used for aluminium components in the automobile industry, in particular such which have to satisfy high mechanical requirements, thus expanding the scope of application of aluminium components in the automobile industry, for example.

These and other objects are attained in accordance with one aspect of the present invention directed to an alloy, that has the following composition:

magnesium 4.5 to 6.5% by weight,
silicon 1.0 to 3.0% by weight,
manganese 0.3 to 1.0% by weight,
chromium 0.02 to 0.3% by weight,
titanium 0.02 to 0.2% by weight,
zirconium 0.02 to 0.2% by weight,
one or more rare earth metals 0.0050 to 1.6% by weight,
iron max. 0.2% by weight
and the remainder aluminium.

In one embodiment of the invention, the alloy has the following composition:

magnesium 5.5 to 6.5% by weight,
silicon 2.4 to 2.8% by weight,
manganese 0.4 to 0.6% by weight,
chromium 0.05 to 0.15% by weight.

In a further preferred embodiment of the alloy according to the invention a zirconium contents of 0.05 to 0.2% by weight is provided.

As rare earth metals samarium, cerium or lanthanum are preferred. These could be included in the alloy on their own or in any combination with one another. Particularly advantageous are the combinations of samarium and cerium or samarium and lanthanum. A particularly preferred alloy comprises the rare earth metals samarium and cerium in a quantity of 0.0050 to 0.8% by weight samarium and 0.0050 to 0.8% cerium.

The adding of samarium and cerium during the solidification of the alloy leads to the formation of precipitation of AlCe and AlSm in various compositions, resulting in a strain-hardening effect.

In addition, by adding cerium the tendency of the alloy to adhere to the mould is reduced, that has an additional advantageous effect on the quality of the die cast part.

An embodiment of the present invention is illustrated based on the mechanical characteristics obtained for the alloys listed below. The mechanical characteristics were determined on die cast stepped test plates with tensile tests according to DIN EN 10002, wherein for the tensile test the 2.7 mm step was used. This wall thickness range is preferred for the production of weldable, and possibly, crash-relevant structural parts. The mechanical characteristics represent the average value of 25 measurements.

The results of the tensile tests carried out are listed in Table 1. In the case of the alloys listed therein the alloys of tests 1 to 4 are in accordance with embodiments of the invention; the reference alloy represents an alloy the composition of which corresponds to an alloy in accordance with the invention, but does not contain any rare earth metal.

| Test | Version | Tensile strength $R_M$ (MPa) | 0.2% elongation limit $R_{p0.2}$ (MPa) | Breaking elongation A (%) |
|---|---|---|---|---|
| 1 | $AlMg_5Si_2MnCr$ + 0.02% Sm | 330 | 200 | 10.4 |
| 2 | $AlMg_5Si_2MnCr$ + 0.04% Sm + 0.02% Ce | 360 | 220 | 9.8 |
| 3 | $AlMg_5Si_2MnCr$ + 0.05% Sm + 0.03% Ce | 330 | 200 | 11.5 |
| 4 | $AlMg_5Si_2MnCr$ + 0.11% Sm + 0.06% Ce | 340 | 200 | 9.5 |
| Ref. | $AlMg_5Si_2MnCr$ | 297 | 179 | 12.8 |

As it can be seen from the table, the adding of cerium and samarium results in a significant increase of the 0.2% elongation limit when compared with the unmodified $AlMg_5Si_2MnCr$ basic alloy.

In addition, the strength values achievable with the aluminium alloys according to embodiments of the invention are at a level that is achieved with forged parts from AlSi1MgMn [sic] in the T6 state, therefore after heat treatment. Due to this and the improved, relative the known aluminium alloys of the AlMgSi type, 0.2% elongation limit, the alloys according to embodiments of the invention are suitable for new fields of application, in particular for the manufacture of heavy-duty aluminium die cast parts, which are subject of increased interest in the automobile industry.

With regard to the mechanical strength values similar results can be also achieved with alloys according to embodiments of the invention, wherein the cerium is partially or totally substituted by lanthanum.

The invention claimed is:

1. An aluminium alloy, comprising:
magnesium 4.5 to 6.5% by weight,
silicon 1.0 to 3.0% by weight,
manganese 0.3 to 1.0% by weight,
chromium 0.02 to 0.3% by weight,
titanium 0.02 to 0.2% by weight,
zirconium 0.02 to 0.2% by weight,
rare earth metals 0.0050 to 1.6% by weight, wherein the rare earth metals comprise samarium, and at least one of cerium and lanthanum,
iron max. 0.2% by weight, and
the remainder aluminium;
wherein the aluminium alloy in a cast state without thermal treatment has a tensile strength of at least 330 MPa.

2. The aluminium alloy of claim 1 comprising:
magnesium 5.5 to 6.5% by weight,
silicon 2.4 to 2.8% by weight,
manganese 0.4 to 0.6% by weight,
chromium 0.05 to 0.15% by weight.

3. The aluminium alloy of claim 1 comprising zirconium in a quantity of 0.05 to 0.2% by weight.

4. The aluminium alloy of claim 1 wherein the rare earth metals comprise cerium and samarium.

5. The aluminium alloy of claim 1 wherein the rare earth metals comprise lanthanum and samarium.

6. The aluminium alloy of claim 1 comprising:
samarium 0.0050 to 0.8% by weight, and
cerium 0.0050 to 0.8% by weight.

7. The aluminium alloy of claim 1 wherein the aluminium alloy in a cast state without thermal treatment has a tensile strength of about 330-360 MPa.

* * * * *